US006705608B2

(12) United States Patent
Kish et al.

(10) Patent No.: US 6,705,608 B2
(45) Date of Patent: Mar. 16, 2004

(54) SHEET MATERIAL CONVEYING APPARATUS WITH ADJUSTABLE TOP GRIPPERS FOR POCKETS

(75) Inventors: William Alan Kish, Dover, NH (US); Mehmet Oktay Kaya, Lee, NH (US); Heiner Philipp Luxem, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/186,534

(22) Filed: Jul. 1, 2002

(65) Prior Publication Data

US 2004/0000751 A1 Jan. 1, 2004

(51) Int. Cl.[7] ..... B65H 29/04

(52) U.S. Cl. ..... 271/206; 294/99.1; 294/104; 294/116; 270/52.25; 198/470.1; 198/803.7; 198/803.9

(58) Field of Search ..... 198/468.2, 470.1, 198/803.7, 644; 271/206, 204, 82, 85; 294/99.1, 104, 116; 270/52.25, 52.27

(56) References Cited

U.S. PATENT DOCUMENTS

| | | | | | |
|---|---|---|---|---|---|
| 4,723,770 | A | * | 2/1988 | Seidel et al. | 270/55 |
| 5,343,806 | A | * | 9/1994 | Fricke et al. | 101/408 |
| 5,395,151 | A | * | 3/1995 | Eberle | 294/104 |
| 5,465,952 | A | * | 11/1995 | Eberle et al. | 271/204 |
| 6,227,588 | B1 | * | 5/2001 | Cassoni | 294/104 |
| 6,234,466 | B1 | * | 5/2001 | Infanger | 270/52.23 |
| 6,299,154 | B1 | * | 10/2001 | Ballestrazzi et al. | 270/52.24 |
| 6,311,968 | B1 | * | 11/2001 | Linder et al. | 270/52.25 |

* cited by examiner

*Primary Examiner*—Richard Ridley
(74) *Attorney, Agent, or Firm*—Davidson, Davidson & Kappel, LLC

(57) ABSTRACT

A sheet material conveying apparatus has at least one pocket running along a track, the pocket including a base section for receiving sheet material and an upper section including at least one upper gripper for holding an edge of the sheet material. The at least one upper gripper is movable between a gripping position and a non-gripping position, and the upper section is movable with respect to the base section to alter a distance of the at least one upper gripper with respect to the base section.

11 Claims, 5 Drawing Sheets

SHEET MATERIAL CONVEYING APPARATUS WITH ADJUSTABLE TOP GRIPPERS FOR POCKETS

BACKGROUND OF THE INVENTION

The present invention relates generally to a sheet conveying apparatus, for example, for conveying newspapers, and more particularly to a sheet conveying apparatus having pockets moving on a track.

U.S. Pat. No. 5,343,806 discloses a swivellable pre-gripper of a sheet-fed printing press and is cited as background on grippers in general.

U.S. Pat. Nos. 4,723,770 and 6,311,968 show top grippers for holding open a first set of printed materials so that a second set printed material may be inserted into the first set of printed materials. The rotational axis of these top grippers is fixed with respect to the pocket. U.S. Pat. Nos. 4,723,770, 5,343,806 and 6,311,968 are incorporated by reference herein.

To adjust pocket sizes, it has been known to alter the position of a bottom stop.

BRIEF SUMMARY OF THE INVENTION

An object of the present invention is to permit for various paper sizes to be better accommodated in moving pockets. Another alternate or additional object of the present invention is to improve the adjustability of pockets.

The present invention provides a sheet material conveying apparatus comprising:

at least one pocket running along a track, the pocket including a base section for receiving sheet material and an upper section including at least one upper gripper for holding an edge of the sheet material, the at least one upper gripper being movable between a gripping position and a non-gripping position, and the upper section being movable with respect to the base section to alter a distance of the at least one upper gripper with respect to the base section.

By altering the top gripper position with respect to the base section, varying product widths can be accommodated without having to adjust a pocket bottom or stop. In addition, better accuracy of the top gripper placement can be achieved with respect to the front of the pocket.

Preferably, the upper gripper is rotatable about an axis in the upper section.

The pocket preferably includes a setting mechanism for moving the upper section with respect to the base section.

The setting mechanism preferably includes a cam follower connected to one of the upper section and the base section. The cam follower may be connected to a shaft of the setting mechanism, with rotation of the shaft setting the distance between the upper section and base section.

Preferably, a latch can be provided to hold the setting mechanism at the distance set by the cam follower.

Preferably, the upper gripper is rotatable but translationally fixed with respect to the upper section.

The present invention also provides a method for setting a distance of a top gripper of a pocket comprising the steps of:

moving a plurality of pockets along a track;

gripping sheet products by rotating the upper gripper about a rotational axis; and adjusting the distance of the rotational axis of the top gripper from a base section of the pocket.

Preferably, the adjusting step occurs concurrently with the moving step, for example through a cam/cam follower interaction.

BRIEF DESCRIPTION OF THE DRAWINGS

An embodiment of the present invention is described below by reference to the following drawings, in which.

DETAILED DESCRIPTION

Figure 1:
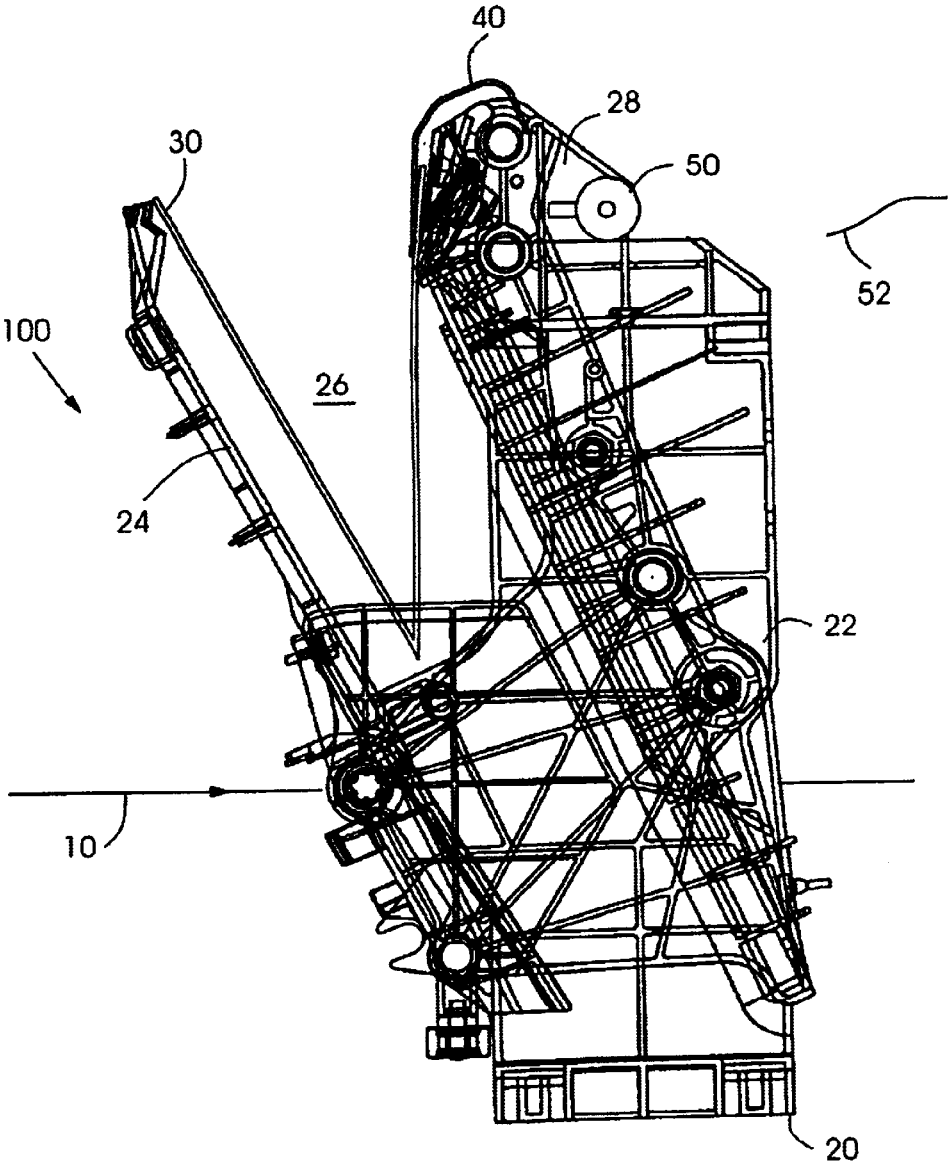
FIG. 1 shows a schematic view of a sheet material conveying apparatus according to the present invention.

FIG. 1 shows a schematic view of a sheet material conveying apparatus 100 having an endless track 10 for transporting a plurality of pockets 20. Each pocket 20 includes a base section 22 with a pocket back 24, and an upper section 28.

Printed products or sheet materials 30, for example newspaper sections, may fit into an opening of the pocket 20. An upper gripper 40, rotatable about a shaft 42, may be translationally fixed with respect to upper section 28. The upper gripper has an open or non-gripping position, and a gripping position where sheet materials 30 are held open, for example, so that other sections may be inserted inside the sheet materials 30.

A cam follower 50 is provided in upper section 28, and may interact with a stationary cam 52 at the side of track 10. The height of cam 52 may be adjustable.

Figure 2:
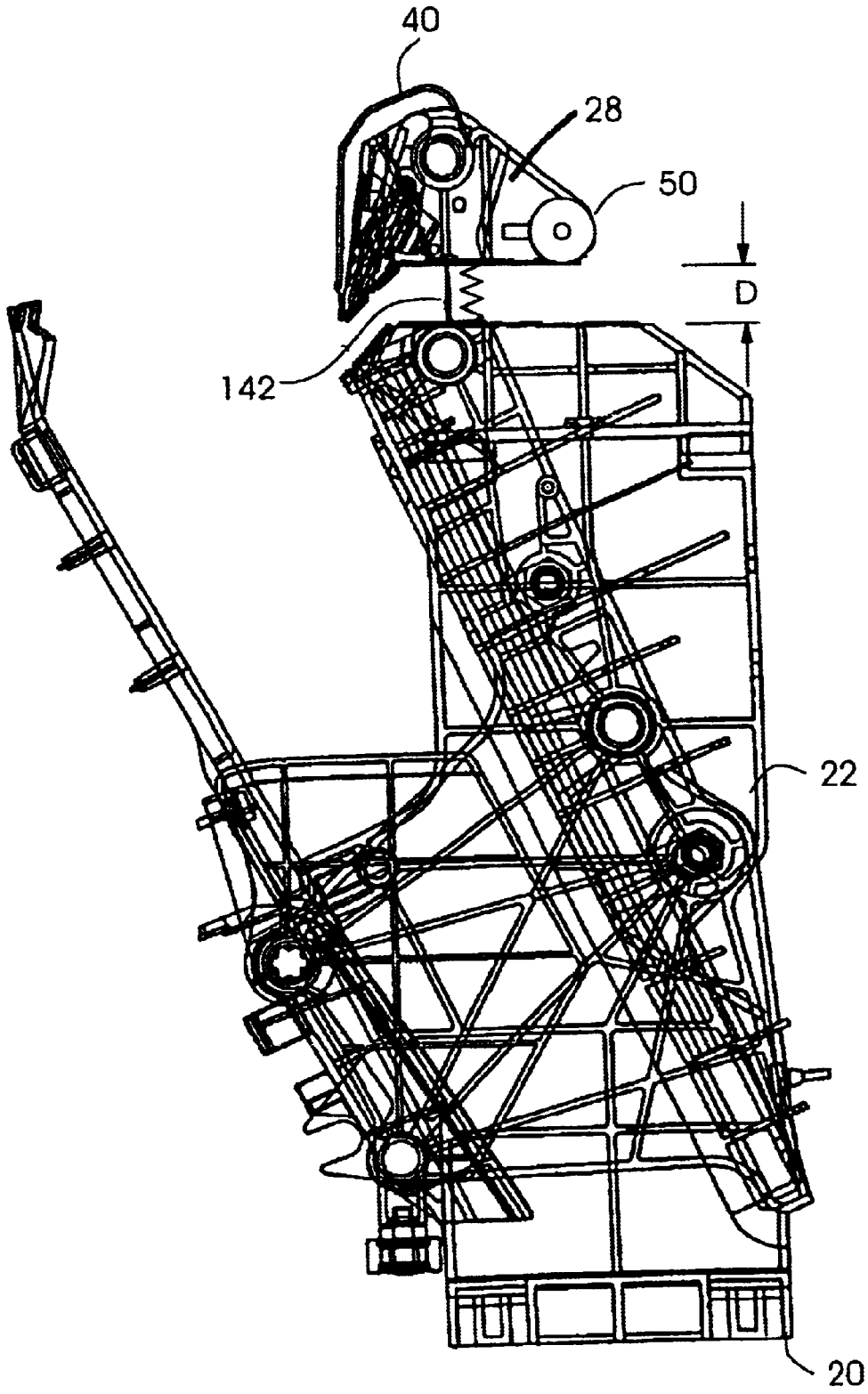
FIG. 2 shows the pocket of FIG. 1 with the upper section set to a new distance.

FIG. 2 shows the result of pocket 20 running past cam 52. Depending on the height of cam 52, a distance D is created between upper section 28 and base section 22, as the cam follower 50 is rotated by the cam 52. A support 142 fixed to base section 22 supports upper section 28 at the distance D.

Figure 3:
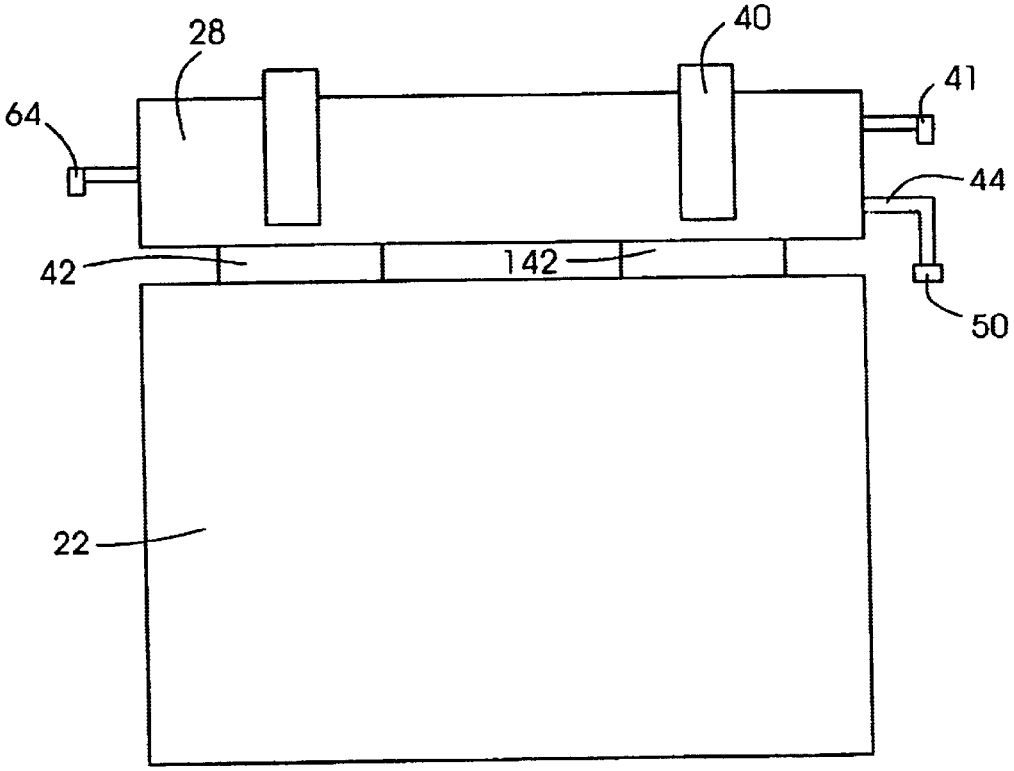
FIG. 3 shows a schematic view of a front of a pocket with certain elements omitted for clarity purposes.
Figure 4:
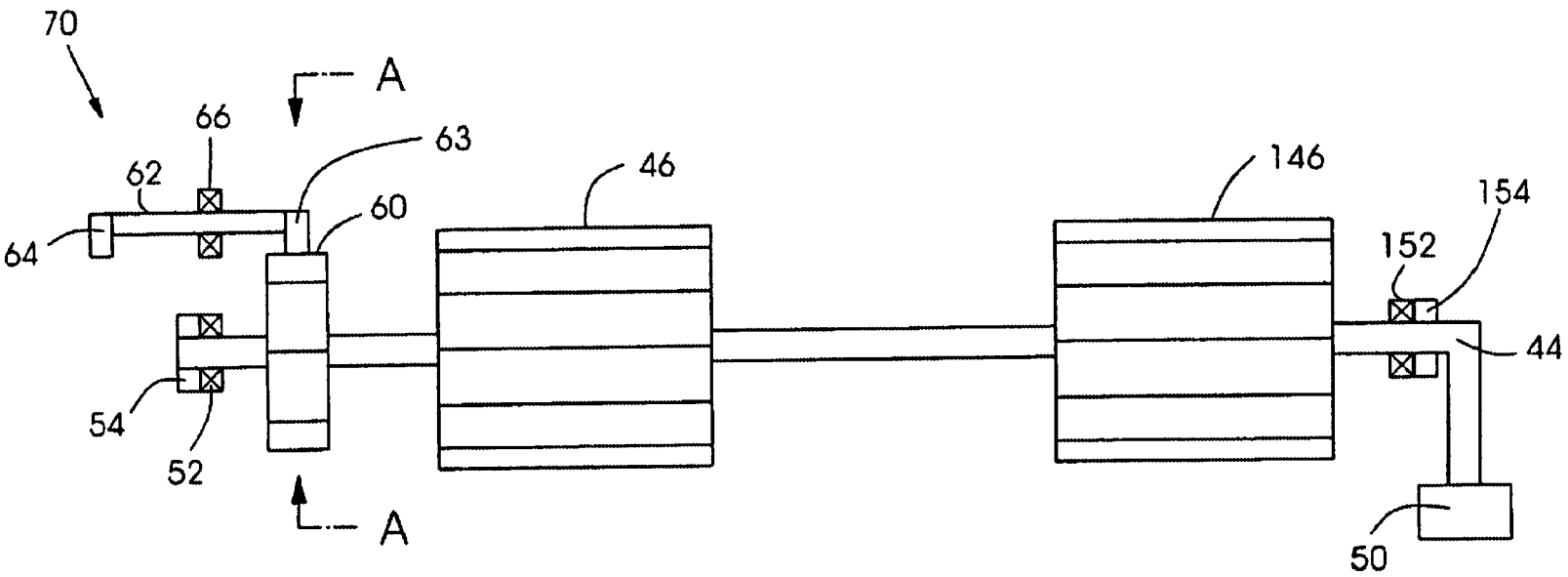
FIG. 4 shows a schematized view of part of the setting mechanism of the present invention.
Figure 5:
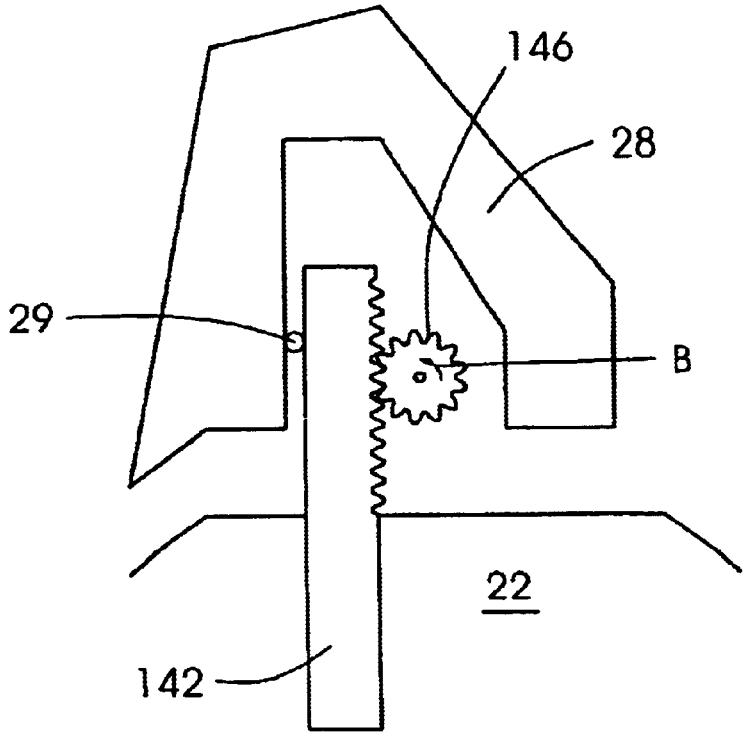
FIG. 5 shows a schematized cross-sectional view of the setting mechanism of the present invention.

As shown in FIGS. 3, 4 and 5, rotation of cam follower 50 causes a shaft 44 to rotate gears 46, 146, which are fixed to shaft 44. The gears 46, 146 interact with toothed sides of supports 42, 142, respectively, both of which are fixed to base section 22. Shaft 44 is rotationally supported in side walls of upper section 28 by bearings 52, 152, but is translationally fixed with respect to upper section 28.

A cam follower 41 may open or close the grippers 40.

As in FIG. 5, rotation of gear 146 in direction B causes upper section 28 to move with respect to support 142 and base section 22. A bearing 29 attached to support 142 or upper section 28 may aid in the sliding movement of upper section 28.

Cam follower 50, shaft 44, gears 46, 146 and supports 42, 142 thus may define a setting mechanism for altering the distance D between the upper section 28 and base section 22.

Figure 6:
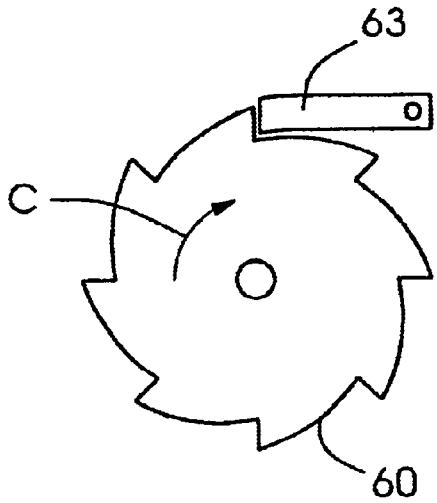
FIG. 6 shows a cross-sectional view through line A—A in FIG. 4.

As shown in FIG. 4, a latch 70 may maintain distance D, even after the pocket 20 passes cam 52 (See FIG. 1). Shaft 44 may be spring-loaded by springs 54, 154 to rotate in a direction opposite to direction B in FIG. 5, i.e. to close the distance D and bring upper section 28 to rest against base section 22. Latch 70 may include a pawl 63 fixed on a shaft 62, which is rotatable by a cam follower 64, as shown in FIG. 3 as well. Shaft 62 may be supported by bearing 66 in the side wall of upper section 28. Pawl 63 interacts with a ratchet 60 fixed to shaft 44, as shown in FIG. 6.

Thus to set height D, all of the pockets 20 can run past a cam for releasing pawl 63 via cam follower 64. Shaft 44 thus rotates in direction C (FIG. 6) counter to direction B (FIG. 5) via spring action caused by springs 54, 154, so that upper section 28 rests against base section 22. Cam 52 is then set to the desired height and pockets 20 run on track 10 past the cam 52, so that cam followers 50 rotate shaft 44 to set the distance of upper section 28 with respect to base section 22.

Sheet materials may then be inserted into openings 26 and the upper edge of the sheet materials gripped by upper grippers 40.

What is claimed is:

1. A sheet material conveying apparatus comprising:

a track; and at least one pocket running along the track, the pocket including a base section for receiving sheet material and an upper section including at least one upper gripper for holding an edge of the sheet material, the at least one upper gripper being movable between a gripping position and a non-gripping position, and the upper section being movable with respect to the base section to alter a distance of the at least one upper gripper with respect to the base section.

2. The apparatus as recited in claim 1 wherein the upper gripper is rotatable about an axis in the upper section.

3. The apparatus as recited in claim 1 wherein the pocket includes a setting mechanism for moving the upper section with respect to the base section.

4. The apparatus as recited in claim 3 wherein the setting mechanism includes a cam follower connected to one of the upper section and the base section.

5. The apparatus as recited in claim 4 wherein the setting mechanism includes a shaft, the cam follower being connected to the shaft, rotation of the shaft setting the distance between the upper section and base section.

6. The apparatus as recited in claim 3 wherein the setting mechanism includes a latch to maintain the distance of the at least one upper gripper with respect to the base section.

7. The apparatus as recited in claim 1 wherein the upper gripper is rotatable but translationally fixed with respect to the upper section.

8. A method for setting a distance of a top gripper of a pocket comprising the steps of:

moving a plurality of pockets along a track;

gripping sheet products by rotating the upper gripper about a rotational axis; and adjusting the distance of the rotational axis of the top gripper from a base section of the pocket.

9. The method as recited in claim 8 wherein the adjusting step occurs concurrently with the moving step.

10. The apparatus as recited in claim 1 further comprising a first feeder for placing the sheet material in the pocket and a second feeder for placing a second sheet material together the sheet material in the pocket.

11. A sheet material conveying apparatus comprising:

a track; and at least one pocket running along the track, the pocket including a base section for receiving sheet material and an upper section including at least one upper gripper for holding the sheet material in an open position, the at least one upper gripper being movable between a gripping position and a non-gripping position, and the upper section being movable with respect to the base section to alter a distance of the at least one upper gripper with respect to the base section.

* * * * *